United States Patent [19]

Persson

[11] 4,302,055

[45] * Nov. 24, 1981

[54] WEDGINGLY MOUNTED TOOL HOLDER OR ADAPTER FOR A CUTTING HEAD

[75] Inventor: Anders E. Persson, Sandviken, Sweden

[73] Assignee: Sandvik Aktiebolag, Sandviken, Sweden

[ * ] Notice: The portion of the term of this patent subsequent to Dec. 25, 1996, has been disclaimed.

[21] Appl. No.: 64,770

[22] Filed: Aug. 8, 1979

Related U.S. Application Data

[63] Continuation-in-part of Ser. No. 881,603, Feb. 27, 1978, Pat. No. 4,180,292.

[51] Int. Cl.[3] ..... E21C 35/18

[52] U.S. Cl. ..... 299/93; 299/39; 407/40; 407/46; 407/47; 279/86

[58] Field of Search ..... 299/87, 39, 91–93; 175/413; 407/40, 46, 47; 279/86, 102

[56] References Cited

U.S. PATENT DOCUMENTS

| | | | |
|---|---|---|---|
| Re. 28,310 | 1/1975 | Krekeler | 299/93 |
| 3,252,391 | 5/1966 | Dils | 404/121 |
| 3,519,309 | 7/1970 | Engle et al. | 299/86 |
| 3,666,321 | 5/1972 | Lundstrom et al. | 299/93 |
| 3,820,849 | 6/1974 | Lundstrom et al. | 299/93 |
| 3,841,708 | 10/1974 | Kniff et al. | 299/86 |
| 3,992,061 | 11/1976 | Rollins | 299/86 |
| 4,006,936 | 2/1977 | Crabiel | 299/39 |
| 4,180,292 | 12/1979 | Persson | 299/92 |

FOREIGN PATENT DOCUMENTS

| | | | |
|---|---|---|---|
| 2319620 | 10/1974 | Fed. Rep. of Germany | 299/91 |

*Primary Examiner*—Ernest R. Purser

*Attorney, Agent, or Firm*—Burns, Doane, Swecker & Mathis

[57] ABSTRACT

A tool mounting for a planing machine in which the cutting tools are exposed to high tangential forces. The tool is held on a rotary drum by a wedging action so as to be more readily replaced. The tool may comprise separate adapter and cutter bit components, or in the form of a one-piece member. The tool adapter includes a projection extending from an end opposite from the cutting tool. The projection includes a first contact surface and the mounting includes a second contact surface located outwardly from the first contact surface which first and second contact surfaces converge toward one another. In this way, the first and second contact surfaces cooperate with corresponding surfaces on the cutting head to wedgingly secure the adapter thereto. In a further embodiment of the present invention, the adapter includes a through-hole communicating with the bore for receiving the tool such that a projection on the recessed casing for the tool can enter the through-hole and the bore to rotatably mount the tool whereby disengagement of the adapter also disengages the tool from the adapter.

25 Claims, 6 Drawing Figures

WEDGINGLY MOUNTED TOOL HOLDER OR ADAPTER FOR A CUTTING HEAD

This application is a continuation-in-part of application Ser. No. 881,603 filed Feb. 27, 1978, now U.S. Pat. No. 4,180,292.

BACKGROUND AND OBJECTS OF THE INVENTION

According to one aspect of the invention the improved attachment is applied in road planing machines of the type comprising a rotating cutter drum on which a helical flange or ring is mounted. Tungsten carbide tipped steel teeth are mounted on the flange. When the cutter drum rotates the teeth strip away concrete or asphalt pavement surfaces to a desired depth. The removed concrete may be re-used as a base material and the removed asphalt may be used on secondary roads, reprocessed into a high quality mix or stock piled for use later on.

In known road planing machines the teeth are mounted in tool holders which are attached to the flange by welding. In use high tangential forces are applied on the teeth which means that the teeth will penetrate backwards into the tool holders, thereby damaging the latter. When a tool holder is to be replaced it has to be cut loose, whereupon a new tool holder is secured to the flange by welding. This is a time consuming and, due to the high machine cost, expensive operation.

One object of the invention is to decrease the downtime during replacement of a tool holder. This is attained by mounting the cutting tooth in an adapter and wedgingly securing the adapter to the drum so that the adapter is readily attachable and detachable.

Another object of the invention is to increase the lengths of the replacement intervals of the tool holders. This is attained by using a large wedge surface on the tool holder for taking up the axial forces acting on the tooth, thereby preventing the teeth from penetrating backwards.

According to a general aspect of the invention the improved tool holder including an adapter is applied in earth excavating machines in general, particularly machines for extraction of earth formations such as coal and rock.

The above and other objects of the invention are attained by giving the invention the characterizing features stated in the appended claims.

The invention is described in detail in the following description with reference to the accompanying drawings in which two embodiments are shown by way of example. It is to be understood that these embodiments are only illustrative of the invention and that various modifications thereof may be made within the scope of the claims.

THE DRAWINGS

DETAILED DESCRIPTION OF A PREFERRED EMBODIMENT OF THE INVENTION

Figure 1:
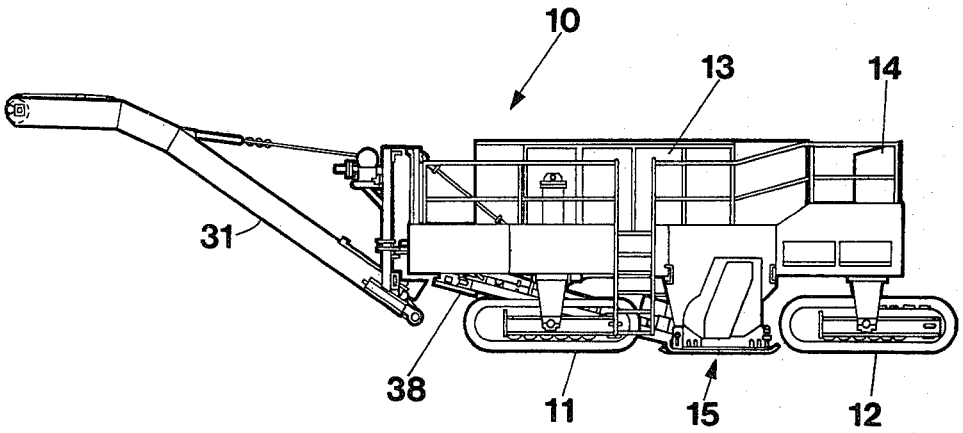
FIG. 1 shows a side view of a road planing machine in which the invention is applied.
Figure 2:
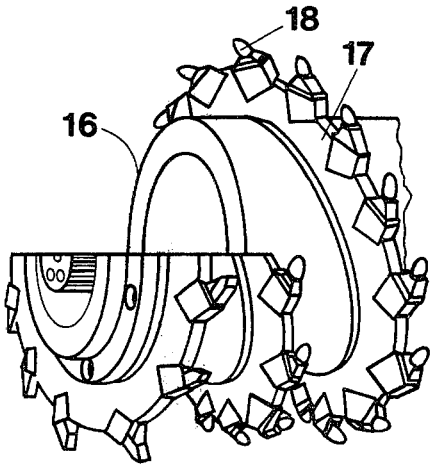
FIG. 2 shows a perspective view of a cutter drum in the road planing machine.

The road planing machine 10 comprises a three point crawler suspension 11,12, an engine 13, an operators control console 14 and a rotary cutter assembly generally denoted by 15. The removed material is brought to a pickup conveyor 38 which transports the material to a load out conveyor 31 from which the material is loaded on a truck.

The rotary cutter assembly 15 comprises a rotary drum 16 on which a helical ring or flange 17 is attached. A plurality of cutting tools 18 are mounted on the flange 17 under mutual spacing. The cutting tool 18 is provided with a cemented carbide tip 26.

Figure 3:
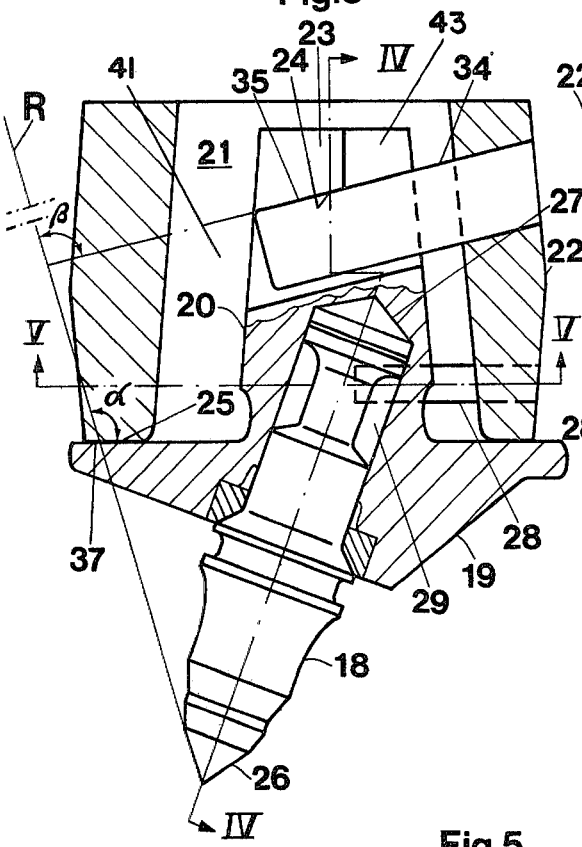
FIG. 3 shows in section a cutting tool mounted in a tool holder.
Figure 4:
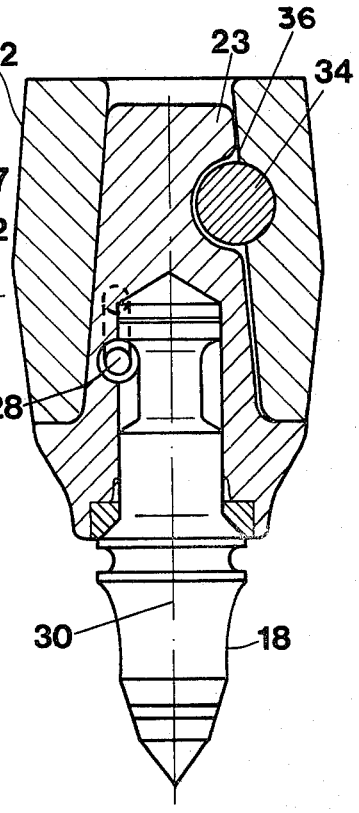
FIG. 4 is a section taken on the line IV—IV in FIG. 3.
Figure 5:
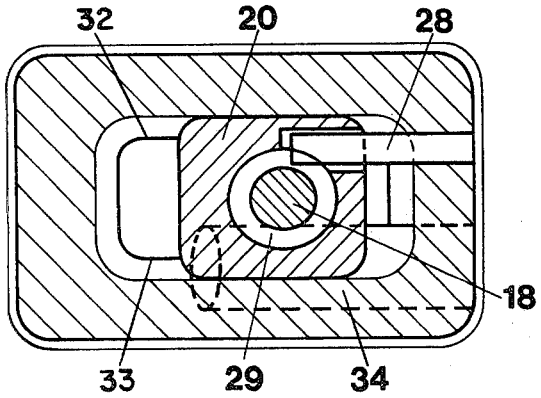
FIG. 5 is a section taken on the line V—V in FIG. 3.

In the embodiment according to FIGS. 3-5 the cutting tool 18 is mounted in a tool holder which comprises an adapter 19. The adapter 19 has a tongue comprising an extension 20 which projects into an outwardly open groove 21 in a tool mounting comprising a casing 22. The casing 22 is welded to the flange 17. It is to be understood that the casing 22 forms part of the flange 17. The groove 21, thus, can be made directly in the flange. The extension 20 comprises a projection 23 which includes an outwardly directed contact surface 24. The adapter 19 includes a contact surface 25 which is located between the contact surface 24 and the tool tip 26. The contact surfaces 24,25 converge in the rotational direction of the drum 16. The side walls 32,33 of the groove 21 and the side walls of the ring 17 run in parallel directions.

The adapter 19 is provided with a bore 27 in which the cutting tool 18 is received. A pin 28 is attached to the casing 22. The pin 28 projects into an annular recess 29 on the cutting tool 18 so as to provide a locking means for preventing unintentional withdrawal of the cutting tool out of the bore 27 while permitting rotation of the cutting tool.

The contact surface 24 is located at the one side of a radial centre plane 30 through the ring 17. Preferably, the centre plane 30 coincides with the centre plane through the casing 22 and the tool 18. An angle $\alpha$ between the radius R of the drum intersecting the tip of the cutter 26, on the one hand, and the contact surface 25 on the other hand, is larger than an angle $\beta$ between the radius R and the contact surface 24. The angle $\alpha$ is obtuse and the angle $\beta$ is acute.

The angles $\alpha$ and $\beta$ are located on a rear side of the radius R relative to the direction of drum rotation, and are located on the radially inward sides of the surfaces 24, 25.

A pin 34 is attached to the casing 22 in the side wall 33 of the groove 21 and extends in the direction of the ring 17. The pin 34 forms a projection from the side wall 33 and includes a contact surface 35 which forms therebeneath an undercut portion 36 of the groove 21. The undercut portion 36 extends generally in the direction of the ring 17. The pin 34 terminates short of the front end of the groove 21; i.e. the left end in FIG. 3, to define an enlarged opening 41. The casing 22 includes a contact surface 37 which extends at an angle relative to the contact surface 35. The enlarged opening 41 at the front end of the pin 34 is sized to receive the extension 20 and the projection 23 such that upon movement of the adapter 19 toward the rear end of the groove 21 the projection 23 travels along the undercut portion 36. The projection 23 is defined by a lateral recess in the extension 20 which recess is shaped similar to the pin 34 to receive the latter when the adapter 19 is inserted into the groove 21. The contact surfaces 35,37 on the casing 22 or ring 17, then, are contacting the contact surfaces 24,25 on the adapter 19, thereby wedgingly securing the adapter 19 to the drum 16. The contact surfaces 35,37 converge in the rotational direction of the drum 16. Preferably, all contact surfaces 24,25, 35,37 are planar. In other words, when it is desired to insert the adapter 19 and the cutting tool 18, the adapter and cutting tool are arranged such that the projection 23 can be slid axially into the groove 21 along the forward portion of the groove (the left hand side as seen in FIG. 3). Once the pin 34 fixed with respect to the casing 22 has cleared an indentation 43 provided in the projection 23, the adapter 19 is moved towards the rear (the right as seen in FIG. 3) such that the pin 34 slides within the recess shaped similarly to the pin 34 provided in the projection 23 causing the adapter to be secured within the casing by wedging action between the surfaces 35 and 24 and between the surfaces 37 and 25. At the same time, the pin 28 fixed with respect to the casing 22 enters a through-hole in the adapter 19 and the annular recess 29 on the cutting tool 18 to provide a locking means for preventing withdrawal of the cutting tool out of the bore 27.

In use, the cutting tool 18 will penetrate backwards into the adapter 19. Due to the fact that the adapter is wedgingly secured it can readily be replaced by a new one when damaged.

Figure 6:
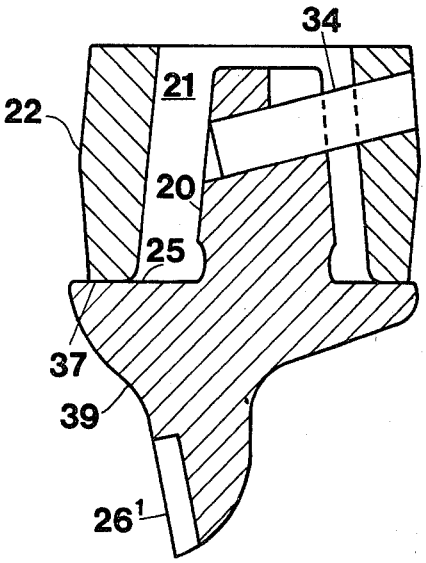
FIG. 6 shows in section a cutting tool mounted in a tool holder according to another embodiment of the invention.

In the embodiment according to FIG. 6 the cutting tool and the adapter are made as an integral unit 39. This means that the axial forces applied on the cutting insert 26' are taken up by the contact surface 37 on the casing 22. This increases the length of the replacement intervals. The embodiment shown in FIG. 6 is particularly designed for cutting asphalt.

What I claim is:

1. In combination, a planing machine for pavement profiling comprising a rotating drum having a helical ring mounted thereon and having a single rotational direction, and a tool mounting comprising:

an elongated outwardly open groove on said ring extending in the rotational direction of said drum, a first contact surface on said ring, said first contact surface being located in said groove radially inwardly of the periphery of said ring, and a second contact surface on said ring, said second contact surface being located radially outwardly of said first contact surface, said first and second contact surfaces being opposed and converging in the rotational direction of said drum, thereby being adapted for securing thereto a cutting tool means by wedge action.

2. Apparatus according to claim 1, wherein a major portion of the first contact surface is located at one side of a radial central plane through the ring.

3. Apparatus according to claim 1, wherein a first angle between a radius of the drum and the second contact surface is larger than a second angle between such radius and the first contact surface.

4. Apparatus according to claim 3, wherein said radius intersects the tip of said cutting tool and said first angle is obtuse and said second angle is acute.

5. Apparatus according to claim 1, wherein at least one side wall of the groove extends parallel to the side walls of the ring.

6. Apparatus according to claim 1 further including a cutting tool received in a bore of said holder, a projection mounted on said ring and passing through said holder to engage said tool whereby disengagement of said holder also disengages said tool from said holder.

7. A planing machine for pavement profiling comprising:

a rotating drum having a helical ring mounted thereon and having a single rotational direction, a tool mounting on said ring, said tool mounting having an elongated outwardly open groove extending in the rotational direction of said drum, a first contact surface on said tool mounting, and a second contact surface on said tool mounting, a major portion of said first contact surface being located in said groove at one side of a central plane through said ring, said first and second contact surfaces being opposed and converging in the rotational direction of said drum for securing thereto by wedge action a cutting tool having corresponding contact surfaces.

8. Apparatus according to claim 7 further including a cutting tool received in a bore of said holder, a projection mounted on said ring and passing through said holder to engage said tool whereby disengagement of said holder also disengages said tool from said holder.

9. The combination of a cutter drum and cutting tool holders for a road planing machine, said cutter drum having a helical ring mounted thereon and each holder being mounted by a tongue and groove connection comprising:

an outwardly open groove formed in said ring, said groove including opposite side walls extending in the direction of said ring, a first projection extending laterally from one of said side walls toward the other side wall, said first projection including a first contact surface forming therebeneath an undercut portion of said groove extending in the direction of said ring, said first projection terminating short of the front end of said groove to define an enlarged opening, said ring including a second contact surface spaced outwardly of said first contact surface and extending at an angle relative thereto, and a tongue comprising an extension of said cutting tool holder, one of the side walls of said extension including a second projection extending laterally in the opposite direction relative to said first projection, said second projection including a third contact surface, said cutting tool holder including a fourth contact surface spaced outwardly of said third contact surface and extending at an angle relative thereto, said enlarged opening to said groove being sized to receive said extension and said second projection such that upon movement of said cutting tool holder toward the rear end of said groove, said second projection travels along said undercut portion of said groove, with said first and third contact surfaces and said second and fourth contact surfaces contacting one another to wedgingly secure said cutting tool holder to said cutter drum.

10. Apparatus according to claim 9, wherein the first and second contact surfaces are planar and convergent and the third and fourth contact surfaces are planar and convergent.

11. Apparatus according to claim 10, wherein said first projection comprises a pin mounted in said one side wall of the groove and extending generally in the direction of the ring.

12. Apparatus according to claim 11, wherein said second projection is defined by a recess in said tongue, said recess shaped similar to said pin and receiving the latter when said cutting tool holder is inserted into said groove.

13. Apparatus according to claim 9, wherein said groove is formed in a generally rectangular casing, said casing being fixedly attached to the ring.

14. Apparatus according to claim 9, wherein said cutting tool holder comprises an adapter on which said third and fourth contact surfaces are provided.

15. Apparatus according to claim 14, wherein the cutting tool is rotatably mounted in said adapter.

16. Apparatus according to claim 15, wherein said adapter is provided with locking means for securing said cutting tool against axial withdrawal out of said adapter while permitting rotation of said cutting tool.

17. Apparatus according to claim 16, wherein said locking means comprises a second pin mounted in the adapter said second pin projecting into an annular recess in the cutting tool.

18. A tool holder for use on a machine of the type having a radius and radially spaced contact surfaces, said tool holder including inner and outer contact surfaces which converge and are adapted to engage the first-named contact surfaces of the machine for securing said holder to the machine by wedge action such that the machine radius passes through a tip of the tool; a first angle between the radius and the outer contact surface being larger than a second angle between such radius and the inner contact surface.

19. A cutting tool adapter intended to receive a cutting tool and to be attached to a cutting head of a machine for extraction of earth formations, said adapter having a projection which projects from said adapter at an end thereof opposite to the cutting tool, said projection including a first contact surface, said adapter including a second contact surface located outwardly of said first contact surface and adapted for contact with said cutting head, said first and second contact surfaces extending at an angle relative to one another, and a bore in said adapter for receiving said cutting tool.

20. Apparatus according to claim 19, wherein said first and second contact surfaces converge in a working direction of the cutting tool.

21. Apparatus according to claim 19, wherein said first and second contact surfaces cooperate with corresponding surfaces on the cutting head to wedgingly secure the adapter thereto.

22. A tool holder adapted for wedging connection within a correspondingly shaped slot of a cutting head, said tool holder comprising:

a tool carrying portion, and a tongue projecting from said tool-carrying portion, said tongue comprising:

a first side wall extending substantially straight to the end of said tongue, and a second side wall including a lateral projection extending away from said first side wall and defining a first wedging abutment.

23. The tool holder of claim 22 further comprising second wedging abutment on the tool carrying portion.

24. The tool holder of claim 23, wherein the first and second wedging abutments converge toward one another.

25. The cutting tool adapter according to claim 19, wherein the adapter is wedgingly mounted to the cutting head, said adapter including a through-hole communicating with said bore so that a projection on the cutting head can enter the through-hole and the bore to rotatably mount the tool whereby disengagement of the adapter also disengages the tool from the adapter.

* * * * *